United States Patent [19]

Tsubuko et al.

[11] Patent Number: 5,061,587

[45] Date of Patent: Oct. 29, 1991

[54] TONER FOR ELECTROPHOTOGRAPHY INCLUDING FLUORINE CONTAINED GRAFT COPOLYMER

[75] Inventors: Kazuo Tsubuko; Shinichi Kuramoto, both of Numazu; Kazuhiko Umemura, Susono; Hidemi Uematsu, Fuji, all of Japan

[73] Assignee: Ricoh Company Ltd., Ohta, Japan

[21] Appl. No.: 421,067

[22] Filed: Oct. 13, 1989

[30] Foreign Application Priority Data

Oct. 18, 1988 [JP] Japan ..... 63-260410

[51] Int. Cl.[5] ..... G03G 9/097

[52] U.S. Cl. ..... 430/109; 430/110

[58] Field of Search ..... 430/110, 114, 109; 525/276, 242

[56] References Cited

U.S. PATENT DOCUMENTS 4,655,963 4/1987 Koga et al. ..... 525/276

4,666,991 5/1987 Matsui et al. ..... 525/276

4,882,258 11/1989 Ikeuchi et al. ..... 430/110

4,916,191 4/1990 Takeuchi et al. ..... 525/242

*Primary Examiner*—John Goodrow

*Attorney, Agent, or Firm*—Cooper & Dunham

[57] ABSTRACT

A toner for developing latent electrostatic images comprising a coloring agent and a fluorine-contained graft copolymer which is prepared by grafting a fluorine-contained monomer to a main polymer comprising a repeating unit represented by formula (I):

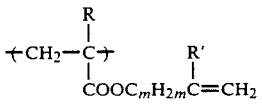

(I)

wherein R and R′ each independently represent H or $CH_3$, and m represent san integer of 1 to 20.

45 Claims, No Drawings

TONER FOR ELECTROPHOTOGRAPHY INCLUDING FLUORINE CONTAINED GRAFT COPOLYMER

BACKGROUND OF THE INVENTION

1. Field of the Invention

This invention relates to a toner and toner particles for electrophotography, and more particularly to a toner and toner particles for electrophotography comprising a coloring agent and a fluorine-contained graft copolymer, which have the image-fixing property suitable for development and image fixing at high speed, do not give rise to an off-set phenomenon, and have high blocking resistance.

2. Discussion of Background

Technique of electrophotography which has long been applied to a copying machine is now extensively utilized for a laser beam-type printer which can achieve high-speed recording. A thermal roller capable of fixing images at high speed is also widely employed these days as an image fixing apparatus. Thus, attention is now focused on high-speed recording.

In addition, high image-fixing ability is strongly demanded in order to satisfy recent various requirements. For example, images are now required to be reproduced or printed on a sheet of paper, such as an envelope for direct mail, which is to be folded at the time when it is used, and on a sheet of paper, such as a post card, which is thicker than ordinary paper.

In order to meet the above requirements, a toner for electrophotography which comprises as its binder a styrene-acryl copolymer resin has been proposed in Japanese Laid-Open Patent Application 50-134652. The toner has a degree of dispersion of 3.5 to 4.0, and hardly give rise to the off-set phenomenon.

Furthermore, a resin composition for a toner for electrophotography has been proposed in Japanese Laid-Open Patent Application 62-115170. This resin composition is composed of styrene-acrylic acid copolymer resins A and B, each having a weight average molecular weight of 10,000 to 30,000 and 200,000 to 400,000, and a glass transition temperature of 60 to 70° C. and 55 to 65° C. The blend ratio (weight basis) of resin A to resin B is 90/10 to 50/50. The melt viscosity at 140° C. of the resin composition is 10,000 ps or less.

Besides the above, some toners have been proposed, which have the image-fixing property suitable for development and image fixing at high speed, do not give rise to the off-set phenomenon, and have high blocking resistance.

However, the conventional toners for electrophotography still have some disadvantages. For example, in the case of a wet type, the toner cannot be stably dispersed in an aliphatic hydrocarbon solvent. In the case where the conventional dry-type toner is employed, images cannot be satisfactorily fixed when fixing energy is low. Thus, a satisfactory toner does not exist so far.

SUMMARY OF THE INVENTION

Accordingly, it is an object of the present invention to provide a toner and toner particles for electrophotography which can be firmly fixed on an image transfer sheet without giving rise to the off-set phenomenon even when high-speed recording is carried out, and have high blocking resistance.

The object of this invention can be attained by a toner or toner particles for electrophotography, comprising a fluorine-contained graft copolymer prepared by grafting a fluorine-contained monomer to a main polymer compound having a repeating unit represented by formula (I):

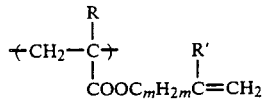

(I)

wherein R and R′ each independently represent H or $CH_3$, and m represents an integer of 1 to 20.

DETAILED DESCRIPTION AND PREFERRED EMBODIMENTS

In order to obtain a toner having improved durability, adhesion and dispersability, it is preferable to employ a fluorine-contained graft copolymer prepared by grafting a fluorine-contained monomer to a main polymer compound having both the repeating unit represented by the above formula (I) and a repeating unit represented by formula (II):

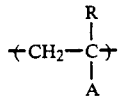

(II)

wherein R represents H or $CH_3$, and A represents $-COOC_nH_{2n+1}$ or $-OCOC_nH_{2n+1}$ in which n is an integer of 6 to 20.

The fluorine-contained graft copolymer is usable in both dry-type and wet-type developers for electrophotography.

A dry-type developer (a dry-type toner) for electrophotography can be prepared by mixing a coloring agent with the above fluorine-contained graft copolymer which serves as a binder agent.

A wet-type developer can be prepared by dispersing a toner which comprises as its main components a coloring agent and the fluorine-contained graft copolymer into a carrier liquid.

The fluorine-contained graft copolymer for use in the present invention has both water and oil repellencies higher than those of the commercially available alternative or random fluorine-contained copolymers. Moreover the graft copolymer is highly soluble in a solvent. Therefore, in the case where the graft copolymer is employed in a toner for electrophotography, the toner hardly adheres to a thermal roller when images are fixed. Thus, the toner can yield images without giving rise to the off-set phenomenon.

In addition, a resin having a low softening point can be used in a toner along with the graft copolymer. When such a toner is employed, images can be fixed at high speed.

It was also confirmed that a toner comprising the graft polymer was highly stable, and has high blocking resistance.

The main polymer compound of the fluorine-contained graft copolymer is compatible with a coloring agent to be used therewith, so that the fluorine molecules are arranged on the surface of the coloring agent. The toner comprising the graft polymer thus exhibits high water and oil repellencies.

On the contrary, fluorine molecules in the alternative or random fluorine-contained copolymer cannot be well arranged on the surface of the coloring agent.

Therefore, the desired repellent effect cannot be obtained.

The fluorine-contained graft copolymer for use in the present invention can be prepared by reacting the main polymer compound having the repeating unit represented by formula (I) with fluorine-contained monomers in the presence of a catalyst under heating. If necessary, the above reaction is allowed to proceed in a non-polar solvent.

The main polymer compound can be either a homopolymer having the repeating unit represented by formula (I) or a copolymer having the repeating unit (I) as one unit.

The homopolymer having the repeating unit (I) can generally be prepared by polymerizing, in a conventional manner, monomers containing allyl groups (hereinafter referred to as Monomer A) which correspond to formula (I).

The copolymer having the repeating unit (I) as one unit can be prepared by polymerizing, in a conventional manner, Monomers A and other polymerizable monomers, especially monomers which correspond to the repeating unit represented by formula (II) (hereinafter referred to as Monomer B). As the polymerizable monomers other than Monomer B, monomers having a polar group (hereinafter referred to as Monomer C) and lower vinyl monomers (hereinafter referred to as Monomer D), which will be described later, can be employed.

In order to improve the dispersion stability of the toner, a skeletal structure of a polymer or copolymer of olefin may be introduced into the backbone chain of the main polymer compound.

Monomer A having allyl groups gives graft points to the backbone chain of the main polymer compound. When Monomer A having a large number of allyl groups are employed, a large number of graft points are formed on the backbone chain of the main polymer compound. However, the number of allyl groups is too large, a cross-linking reaction tends to occur in one molecule or between two molecules through the allyl groups. As a result, the graft copolymer cannot be dispersed stably. It is therefore preferable to employ a copolymer as the main polymer in the present invention. In this case, the weight ratio of Monomers A to other polymerizable monomers is preferably (1 to 50)/(50 to 99).

Specific examples of Monomer A include the following monomers:

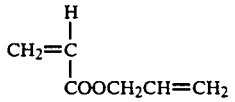
No. 1

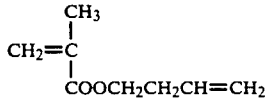
No. 2

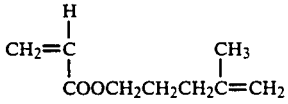
No. 3

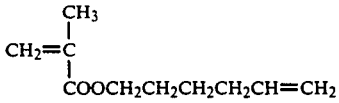
No. 4

-continued

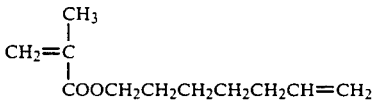
No. 5

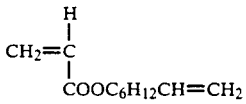
No. 6

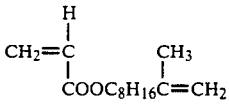
No. 7

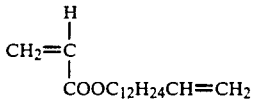
No. 8

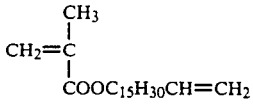
No. 9

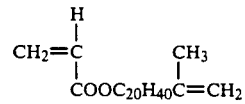
No. 10

Monomer B which corresponds to the repeating unit (II) is employed in order to improve durability, adhesion and dispersion stability of the toner.

Specific examples of Monomer B include lauryl acrylate, lauryl methacrylate, stearyl methacrylate, 2-ethylhexyl methacrylate, 2-ethylhexyl acrylate, dodecyl methacrylate, dodecyl acrylate, hexyl methacrylate, hexyl acrylate, octyl acrylate, octyl methacrylate, cetyl methacrylate, cetyl acrylate, vinyl laurate, vinyl stearate, nonyl methacrylate, nonyl acrylate, decyl methacrylate, decyl acrylate, cyclohexyl methacrylate and cyclohexyl acrylate.

Monomer C having a polar group such as a carboxyl group, a glycidyl group or a hydroxyl group can also improve adhesion, elasticity and dispersion stability of the toner.

Specific examples of Monomer C include acrylic acid, methacrylic acid, itaconic acid, maleic acid, and fumalic acid. Examples of the monomers having a glycidyl group include glycidyl acrylate, glycidyl methacrylate, glycidylpropyl methacrylate, glycidylpropyl acrylate, glycidylbutyl acrylate, and glycidylbutyl methacrylate. Examples of the monomers having a hydroxyl group include hydroxyethyl methacrylate and hydroxyethyl acrylate.

Monomer D, a lower vinyl monomer, is employed in order to improve film formation property and adhesion of the toner.

Specific examples of Monomer D include methyl methacrylate, methyl acrylate, ethyl acrylate, ethyl methacrylate, propyl methacrylate, propyl acrylate, n-butyl methacrylate, iso-butyl methacrylate, vinyl acetate, vinyl toluene, styrene, p-chlorostyrene, divinyl benzene, diethylene glycol dimethacrylate, trimethyrol propane trimethacrylate, dimethyl aminoethyl methacrylate, acrylonitrile, vinyl pyrrolidone, vinyl pyridine and dimethyl aminomethyl methacrylate.

Furthermore, in order to improve dispersion stability of the toner, a polymer or copolymer of olefin may be introduced into the backbone chain of the main polymer compound.

Examples of the polymer or copolymer of olefin include polyethylene, particularly those called a polyethylene wax, polypropylene, particularly those called a polypropylene wax, a copolymer of ethylene and propylene, a copolymer of ethylene and vinyl acetate, a copolymer of ethylene, vinyl acetate and acrylic acid, a copolymer of ethylene and acrylic acid, a copolymer of ethylene, propylene and maleic acid, a copolymer of propylene and ethyl acrylate, a copolymer of ethylene, ethyl acrylate and glycidyl methacrylate, a copolymer of propylene and maleic anhydride, and a copolymer of ethylene, ethylacrylate and maleic anhydride.

The skeletal structure of the above polymer or copolymer can be introduced into the backbone chain of the main polymer compound by simply adding the polymer or copolymer to the reaction system when the main polymer compound is prepared.

Examples of the fluorine-contained monomers which are graft-copolymerized with the main polymer compound include fluoroalkyl acrylate whose fluoroalkyl moiety is $-CH_2CF_3$, $-CH_2C_2F_5$, $-CH_2C_3F_7$, $-CH_2C_4H_9$, $-CH_2C_5F_{11}$, $-CH_2C_7F_{15}$, $-CH_2C_8F_{17}$, $-CH_2C_9F_{19}$ or $-CH_2C_{10}F_{21}$, fluoroalkyl methacrylate whose fluoroalkyl moiety is $-CH_2CF_3$, $-CH_2(CF_2)_4H$, $-(CH_2)C_3F_7$, $-(CH_2)_5C_8F_{17}$, $CH_2(CF_2)_6H$, $-CH_2(CF_2)_8H$, $-(CH_2)_2(CF_2)_7CF_3$, $-CH_2C_{20}F_{41}$ or $-(CH_2)_2(CF_2)_8H$.

When the fluorine-contained graft copolymer for use in the present invention is prepared, the main polymer compound is made to react with the fluorine-contained monomers in a weight ratio of ($_{50}$ to 99)/(1 to 50), preferably (70 to 90)/ (10 to 30).

Examples of the catalyst used for the polymerization of the fluorine-contained graft copolymer include azobisisobutyronitrile (hereinafter referred to as AIBN), benzoyl phenyl methane, lauryl peroxide, di-t-butyl peroxide, t-butyl peroxide and cumen hydroperoxide.

Examples of the non-polar solvent used for the polymerization of the graft copolymer include petroleum aliphatic hydrocarbons such as kerosene, ligroine, n-hexane, n-heptane, n-octane, i-octane, i-dodecan, halogenated aliphatic hydrocarbons such as carbon tetrachloride and perfluoro ethylene. As the petroleum aliphatic hydrocarbons, there can be employed Isopar H, Isopar G, Isopar L, Isopar K, Naphtha No. 6 and Solvesso 100 (Trademarks) all available from Exxon Chemical Japan Ltd.

A small amount of acromatic solvent such as toluene or xylene may be added to the above aliphatic hydrocarbon solvents.

The fluorine-contained graft copolymer prepared in the above-described manner has a diameter in the range of approximately 0.1 to 5 μm, so that it has high dispersion stability. In addition, the copolymer has intermolecular adhesion. Therefore the graft copolymer is suitable as a material for paint, printing ink and toner.

The preparation examples of the fluorine-contained graft copolymer for use in the present invention are given below.

PREPARATION EXAMPLE 1

In a flask equipped with an agitator, a thermometer, a condenser and a dropping funnel, 100 g of laurylmethacrylate, 10 g of the previously mentioned monomer No. 1 (Monomer A) and 1 g of BPO were placed, and polymerization was conducted at 80° C. for 4 hours.

While adding 5 g of $CH_2{=}CHCH_2C_{10}F_{21}$ and 0.2 g of BPO dropwise to the above reaction mixture for one hour, graft polymerization was conducted at 80° C.

The rate of polymerization of the resulting graft copolymer was 96%. The contact angles of the graft copolymer to water and to kerosene were 25 degree and 28 degree, respectively.

On the other hand, a comparative copolymer was prepared using as the starting materials 100 g of lauryl methacrylate, 10 g of monomer No. 1 (Monomer A) and 5 g of $CH_2{=}CHCH_2C_{10}F_{21}$. The polymerization was conducted in the presence of 1.2 g of BPO at 80° C. for one hour. The contact angles of the resulting copolymer to water and to kerosene were 12 degree and 18 degree, respectively.

It was thus confirmed that water and oil repellencies of the graft copolymer for use in the present invention were higher than those of the comparative copolymer.

PREPARATION EXAMPLE 2

In a flask equipped with an agitator, a thermometer, a condenser and a dropping funnel, 100 g of kerosene was placed, and heated to 90° C.

To this heated kerosene, 90 g of 2-ethylhexyl methacrylate, 30 g of monomer No. 3 (Monomer A) and 2 g of BPO were added under stirring, and polymerization was conducted for 6 hours.

10 g of $CH_2{=}C(CH_3)CH_2CH_2C_3F_7$ and 0.5 g of BPO were added to the above reaction mixture, and graft polymerization was conducted at 80° C. for 5 hours.

The rate of polymerization of the resulting graft copolymer was 93.5%. The contact angles of the graft copolymer to water and to kerosene were 43 degree and 50 degree, respectively.

The graft copolymer was dip-coated onto a piece of cloth. The surface-treated cloth was washed 10 times by a washing machine. The contact angle to water on the cloth was 38 degree. It was thus confirmed that the graft copolymer had considerably high durability, and also maintained high flexibility.

PREPARATION EXAMPLE 3

In a flask equipped with an agitator, a thermometer, a condenser and a dropping funnel, 400 g of Isopar G (Trademark) was placed, and heated to 90° C.

To this heated Isopar G, a monomer mixture consisting of 200 g of cyclohexyl acrylate, 10 g of monomer No. 6 (Monomer A), 5 g of methacrylic acid, 10 g of glycidyl methacrylate and 3 g of BPO was added, and polymerization was conducted at 90° C. for 4 hours.

Thereafter, 0.1 g of vinyl pyridine was added to the above reaction mixture, and polymerization was continued at 80° C. for a further 10 hours.

To the resulting mixture, 50 g of $CH_2{=}C(CH_3)CH_2(CF_2)_6H$ and 3 g of AIBN were added, and graft polymerization was conducted at 90° C. for 1 hour.

The rate of polymerization of the resulting graft copolymer was 98%. The contact angles of the graft copolymer to water and to kerosene were 26 degree and 20 degree, respectively.

No precipitation was found in a dispersion containing the graft copolymer even after the preservation at room temperature for 6 months or more.

PREPARATION EXAMPLE 4

In a flask equipped with an agitator, a thermometer, a condenser and a dropping funnel, 50 g of polyethylene wax (Trademark "AC Polyethylene 1106" made by Allied Chemical Corp.) was placed, and heated to 90° C. to be fused.

To this fused wax, a monomer mixture consisting of 100 g of methylmethacrylate, 200 g of monomer No. 9 (Monomer A), 1 g of acrylic acid, 8 g of glycidyl acrylate and 10 g of AIBN was added dropwise for 2 hours under stirring, and polymerization was conducted at 90° C. for 6 hours.

To the resulting mixture, 100 g of methylmethacrylate, 50 g of $CH_2{=}C(CH_3)CH_2C_{20}F_{41}$ and 5 g of t-butyl peroxide were added, and graft polymerization was conducted at 130° C. for 6 hours under stirring.

The rate of polymerization of the resulting graft copolymer was 98.5%. The contact angles of the graft copolymer to water and to kerosene were 32 degree and 40 degree, respectively.

The graft copolymer was coated onto a polyethylene terephthalate film by means of hot-melt coating. High adhesion between the copolymer and the film was observed, and the flexibility of the film coated with the copolymer was also found good.

Other materials used for the toner of the present invention are the same as those used for the conventional toners for electrophotography.

Explanation of materials used for a dry-type toner is given below.

Examples of a coloring agent usable in the toner of the present invention include carbon black, nigrosine dye, Aniline Blue, Calconyl Blue, Chrome Yellow, Ultramarine Blue, Du Pont Oil Red, Quinoline Yellow, Malachite Green Oxalate, Lamp Black and Rose Bengall. These coloring agents can be used either singly or in combination.

The amount of the coloring agent is preferably in the range of 3 to 50 wt. % of the total weight of the toner. However, this amount varies depending on the materials employed in the toner, and may exceed the above range.

Materials used for a wet-type toner are as follows:

Those coloring agents which are used in the dry-type toner can also be used in a wet-type toner.

Non-polar solvents which are used for the preparation of the fluorine-contained graft copolymer can also be employed as a carrier liquid. The most preferable example of such a non-polar solvent is petroleum aliphatic hydrocarbon.

It is preferable that the surface of the coloring agent be treated with the fluorine-contained graft copolymer. As a matter of course, the coloring agent can be employed without being treated with the graft copolymer. In this case, the graft copolymer is incorporated into the toner as a binder resin.

The toner for electrophotography according to the present invention is prepared in the following manner.

DRY-TYPE TONER

The fluorine-contained graft copolymer and the coloring agent are mixed and kneaded. If necessary, some auxiliary components which can improve image fixing ability and off-set prevention ability, charging or polarity control agents, and binder resins can be added to the above basic components of the toner. The resulting mixture is crushed into finely-divided particles having the desired size. It is preferable that the particle size of the toner particles be in the range of 5-30 μm.

In the above process, a preferred kneading method is such that the resin components of the toner is fused under application of heat and sheared mechanically. For example, the method in which the toner mixture is passed through a pair of thermal rollers, the method in which the toner mixture is stirred and mixed by a thermal screw, and the method in which the fused toner mixture is extruded from pores by pressure. Any one of other kneading methods can be employed as far as it can fuse and shear the toner mixture.

The toner mixture thus kneaded is mechanically pulverized by the known method using, for example, hammer mill or jet mill into fine particles having an average size of approximately 5 to 30 μm.

In order to improve image fixing ability and off-set preventing ability, rosin esters, derivatives of amide compounds, waxes such as paraffin wax, caster wax and carnauba wax, and ionomer resins may be employed.

As the charging or polarity control agent, Oil Black BY (Trademark, made by Orient Chemical Industries, Ltd.), Alkaline Blue, Bendizine Yellow and nigrosine may be used.

Examples of the binder resin which can be used in the dry-type toner of the present invention include polyolefins, copolymers of styrene and acrylic acid, and rosin-modified maleic acid resins.

WET-TYPE TONER

The wet-type toner of the present invention can be prepared in the following manner.

The fluorine-contained graft copolymer, the coloring agent and a small amount of the carrier liquid are placed in a dispersing apparatus such as a keddy mill, attritor or ball mill. If necessary, a dispersion stability improving agent and a binder resin ar also placed in the above dispersing apparatus. The above mixture is dispersed for 24 to 30 hours to prepare a toner having a particles size of 0.1 to 2 μm.

In the case where the coloring agent is surface-treated with the fluorine-contained graft copolymer, the following method can be employed.

The coloring agent, the fluorine-contained graft copolymer, and, if necessary, a binder resin are kneaded under application of heat. The resulting mixture is pulverized to obtain a resin-coated coloring agent. The coloring agent is then dispersed in the carrier liquid together with a binder resin.

Examples of the binder resin which is used for binding the coloring agent and the graft copolymer include a graft copolymer of ethylene and maleic acid, a copolymer of ethylene, ethylacrylate and methacrylate, a copolymer of ethylene, ethylacrylate and acrylic acid, a copolymer of propylene and methylacrylate, and a copolymer of ethylene, ethylacrylate and maleic anhydride.

Examples of the binder resin which is employed together with the resin-coated coloring agent include a copolymer of lauryl methacrylate and glycidyl methacrylate and a copolymer of 2-hexylmethacrylate and dimethylaminoethyl methacrylate.

Other features of this invention will become apparent in the course of the following description of exemplary embodiments, which are given for illustration of the invention and are not limiting thereof.

EXAMPLE 1

All components shown in the following formulation were mixed, and the resulting mixture was fused and kneaded by a kneader. After cooling the mixture, it was crushed roughly, and then finely pulverized by a jet mill. The fine powder thus obtained was subjected to a zig-zag classification to selectively obtain particles having a size of 5 to 25 μm, thereby obtaining a desired toner.

The above toner was mixed with an iron oxide carrier "EFV 200/300" (Trademark, made by Nihon Teppun Co., Ltd.), whereby toner No. 1 according to the present invention, containing 5 wt. % of the toner, was prepared.

| [Formulation of Toner] | parts by weight |
|---|---|
| Graft copolymer prepared in Preparation Example 1 | 80 |
| Charging control agent: "Oil Black BY" (Trademark) made by Orient Chemical Industries, Ltd. | 2 |
| Carbon: "Mitsubishi Carbon #44" (Trademark) made by Mitsubishi Chemical Industries, Ltd. | 15 |
| Polypropylene: "Viscose 550P" (Trademark) made by Sanyo Chemical Industries, Ltd. | 3 |

The off-set preventing ability and the blocking resistance of the above-prepared toner was evaluated in the following manner.

Latent images were developed with the above toner using a copying machine "SF-750" (Trademark, made by Sharp Corporation), and the developed images were fixed using an oilless Teflon thermal roller.

The conditions for the image fixing were:

line pressure=0.5 kg/cm, nip width=4 mm, paper feeding speed=80 mm/sec, temperature of the roller=changed.

The initiation temperature of the off-set temperature was measured.

In order to evaluate the blocking resistance, the toner was preserved at 50° C. for 7 days. After the preservation, the toner as visually observed whether or not blocking had been occurred.

The results are shown in Table 1.

COMPARATIVE EXAMPLE 1

Example 1 was repeated except that the graft copolymer used in Example 1 was replaced by a random copolymer prepared by polymerizing the same monomers as those used for the graft copolymer, whereby comparative toner No. 1 was prepared.

The above-obtained toner was evaluated in the same manner as in Example 1. The results are shown in Table 1.

EXAMPLE 2

Example 1 was repeated except that 80 parts by weight of the graft copolymer used in Example 1 was replaced by 50 parts by weight of the graft copolymer prepared in Preparation Example 2 and 30 parts by weight of a styrene-acrylic acid copolymer, whereby toner No. 2 according to the present invention was prepared.

The above-obtained toner was evaluated in the same manner as in Example 1. The results are shown in Table 1.

COMPARATIVE EXAMPLE 2

Example 2 was repeated except that the graft copolymer used in Example 2 was replaced by a random copolymer prepared by polymerizing the same monomers as those used for the graft copolymer, whereby toner No. 2 according to the present invention was prepared.

The above-prepared toner was evaluated in the same manner as in Example 1. The results are shown in Table 1.

EXAMPLE 3

Example 1 was repeated except that 80 parts by weight of the graft copolymer used in Example 1 was replaced by 30 parts by weight of the graft copolymer prepared in Preparation Example 3 and 50 parts by weight of rosin-modified maleic acid resin, whereby toner No. 3 according to the present invention was prepared.

The above-prepared toner was evaluated in the same manner as in Example 1. The results are shown in Table 1.

COMPARATIVE EXAMPLE 3

Example 3 was repeated except that the graft copolymer used in Example 3 was replaced by a random copolymer prepared by polymerizing the same monomers as those used for the graft copolymer, whereby comparative toner No. 3 was prepared.

The above-prepared toner was evaluated in the same manner as in Example 1. The results are shown in Table 1.

TABLE 1

| | Resin Components (parts by weight) | Blocking Resistance* | Off-Set Preventing Ability** |
|---|---|---|---|
| Toner No. 1 | Graft Copolymer (80) Polypropylene (3) | ○ | 188° C. |
| Comp. Toner No. 1 | Random Copolymer (80) | Δ | 170° C. |
| Toner No. 2 | Graft Copolymer (50) Styrene-Acrylic Acid Copolymer (30) | ○ | 193° C. |
| Comp. Toner No. 2 | Random Copolymer (50) Styrene-Acrylic Acid Copolymer (30) | X | 160° C. |
| Toner No. 3 | Graft Copolymer (30) Rosin-Modified Maleic Acid Resin (50) | ○ | 186° C. |
| Comp. Toner No. 3 | Random Copolymer (30) Rosin-Modified Maleic Acid Resin | X | 152° C. |

TABLE 1-continued

| Resin Components (parts by weight) | Blocking Resistance* | Off-Set Preventing Ability** |
|---|---|---|
| (50) | | |

*after preservation at 50° C. for 7 days
○: no blocking was observed
Δ: blocking was slightly observed
X: blocking was observed
**The temperatures shown in the table is the temperatures at which off-set phenomenon was initiated.

EXAMPLE 4

A mixture of 100 parts by weight of "Mitsubishi Carbon #44" (Trademark, made by Mitsubishi Chemical Industries, Ltd.), 50 parts by weight of the graft copolymer prepared in Preparation Example 4 and 500 parts by weight of "Isopar H" (Trademark, made by Exxon Chemical Japan, Ltd.) was dispersed in an attritor for 10 hours, thereby obtaining wet-type toner No. 4, having a particle size of 1.3 μm, according to the present invention.

Latent images were developed with the above toner, and the developed images were fixed using a thermal roller whose surface temperature was changed from 100 to 130° C. The images were fixed firmly without undergoing the of-set phenomenon.

COMPARATIVE EXAMPLE 4

Example 4 was repeated except that the graft copolymer used in Example 4 was replaced by a random copolymer prepared by polymerizing the same monomers as those used for the graft copolymer, whereby comparative wet-type toner No. 4 was prepared.

Latent images were developed with the above toner, and the developed images were fixed using a thermal roller whose surface temperature was changed from 100 to 130° C. During the image fixing, the off-set phenomenon was observed.

EXAMPLE 5

400 parts by weight of carbon weight "MA-11" (Trademark, made by Mitsubishi Carbon Ltd.) and 600 parts by weight of a graft copolymer of ethylene (98) and maleic anhydride (2) were placed in a gallon kneader, and kneaded at 120° C. for 2 hours.

To the resulting mixture, 100 parts by weight of the graft copolymer prepared in Preparation Example 5 was added, and kneaded at 120° C. for a further 1 hour under heating, thereby obtaining a coloring agent.

The coloring agent was pulvurized to particles having a size of 2 mm or less to obtain Coloring Agent A for a wet-type toner.

PREPARATION OF TONER

A mixture of 100 parts by weight of Coloring Agent A, 50 parts by weight of a copolymer of lauryl methacrylate and glycidyl methacrylate (90/10 weight basis) and 500 parts by weight of "Isopar L" (Trademark, made by Exxon Chemical Japan Ltd.) was dispersed by an attritor at 40° C. for 40 hours, whereby wet-type toner No. 5 according to the present invention was prepared.

Latent images were developed with the above toner, and the developed images were fixed using a thermal roller whose surface temperature was changed from 125 to 145° C. The images were fixed firmly without undergoing the off-set phenomenon.

COMPARATIVE EXAMPLE 5

Example 5 was repeated except that the graft copolymer prepared in Preparation Example 5 was eliminated from the formulation of the coloring agent for the wet-type toner, whereby comparative wet-type toner No. 5 was prepared.

Latent images were developed with the above toner, and the developed images were fixed using a thermal roller whose surface temperature was changed from 125 to 145° C. During the image fixing, the off-set phenomenon was slightly observed.

EXAMPLE 6

400 parts by weight of carbon black "Reagal 400" (Trademark, made by Cabot Corporation), 10 parts by weight of ammonium huminate and 500 parts by weight of water were placed in a kneader, and dispersed at 25° C.

700 parts by weight of a copolymer of ethylene, ethylacrylate and methacrylic acid (60/35/5 weight basis) and the graft copolymer prepared in Preparation Example 6 were added to the above-prepared water-contained carbon paste, and mixed for approximately 1 hour. The resulting mixture was kneaded at 130° C. for 2 hours, and then subjected to flushing. After removing the water, the mixture was kneaded at 120° C. for a further 2 hours, followed by removal of the volatile components from the mixture under reduced pressure. Thus, Coloring Agent B was obtained.

By using Coloring Agent B, wet-type toner No. 6 according to the present invention was prepared in the same manner as in Example 5.

Latent images were developed with the above toner, and the developed images were fixed using a thermal roller whose surface temperature was changed from 125 to 145° C. The images were fixed firmly without undergoing the off-set phenomenon.

COMPARATIVE EXAMPLE 6

Example 6 was repeated except that the graft copolymer prepared in Preparation Example 6 was eliminated from the formulation of the coloring agent for the wet-type toner, whereby comparative wet-type toner No. 6 was prepared.

Latent images were developed with the above toner, and the developed images were fixed using a thermal roller whose surface temperature was changed from 125 to 145° C. During the image fixing, the off-set phenomenon was slightly observed.

EXAMPLE 7

The coloring agent prepared in Example 6 was classified by a zig-zag classifier, and particles having a size of 5 to 25 μm were obtained as a toner. The toner was formulated into a dry-type toner in the same manner as in Example 1, whereby toner No. 7 according to the present invention was prepared.

The above toner was evaluated in the same manner as in Example 1. As a result, the initiation temperature of the off-set phenomenon was 184° C. After the preservation at 50° C. for 7 days, the toner was found to be free from blocking.

As described above, the toner comprising as its main component the fluorine-contained graft copolymer of the present invention reveals high blocking resistance, image fixing ability and off-set preventing ability.

What is claimed is:

1. A toner for developing latent electrostatic images comprising a coloring agent and a fluorine-contained graft copolymer which is prepared by grafting a fluorine-contained monomer to a main polymer comprising a repeating unit represented by formula (I):

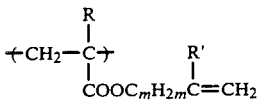

(I)

wherein R and R' each independently represent H or $CH_3$, and m represents an integer of 1 to 20.

2. The toner as claimed in claim 1, wherein said main polymer further comprises a repeating unit represented by formula (II):

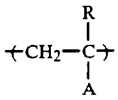

(II)

wherein R represents H or CH3, and A represents $-COOC_nH_{2n+1}$ or $-OCOC_nH_{2n+1}$ in which n is an integer of 6 to 20.

3. The toner as claimed in claim 1, wherein said main polymer further comprises a monomer unit having a polar group.

4. The toner as claimed in claim 1, wherein said main polymer further comprises a lower vinyl-type monomer unit.

5. The toner as claimed in claim 1, wherein said main polymer further comprises an olefin polymer or copolymer.

6. The toner as claimed in claim 2, wherein said repeating unit of formula (II) is selected from the group consisting of the monomer units of lauryl acrylate, lauryl methacrylate, stearyl methacrylate, 2-ethylhexyl methacrylate, 2-ethylhexyl acrylate, dodecyl methacrylate, dodecyl acrylate, hexyl methacrylate, hexyl acrylate, octyl acrylate, octyl methacrylate, cetyl methacrylate, cetyl acrylate, vinyl laurate, vinyl stearate, nonyl methacrylate, nonyl acrylate, decyl methacrylate, decyl acrylate, cyclohexyl methacrylate and cyclohexyl acrylate.

7. The toner as claimed in claim 3, wherein said polar group of said monomer unit is selected from the group consisting of a carboxyl group, a glycidyl group and a hydroxyl group.

8. The toner as claimed in claim 3, wherein said monomer unit is selected from the group consisting of the monomer units of acrylic acid, methacrylic acid, itaconic acid, maleic acid, and fumalic acid.

9. The toner as claimed in claim 3, wherein said monomer unit is selected from the group consisting of the monomer units of glycidyl acrylate, glycidyl methacrylate, glycidylpropyl methacrylate, glycidylpropyl acrylate, glycidylbutyl acrylate, and glycidylbutyl methacrylate.

10. The toner as claimed in claim 3, wherein said monomer unit is selected from the group consisting of the monomer units of hydroxyethyl methacrylate, and hydroxyethyl acrylate.

11. The toner as claimed in claim 4, wherein said lower vinyl-type monomer unit is selected from the group consisting of the monomer units of methyl methacrylate, methyl acrylate, ethyl acrylate, ethyl methacrylate, propyl methacrylate, propyl acrylate, n-butyl methacrylate, iso-butyl methacrylate, vinyl acetate, vinyl toluene, styrene, p-chlorostyrene, divinyl benzene, diethylene glycol dimethacrylate, trimethyrol propane trimethacrylate, dimethyl aminoethyl methacrylate, acrylonitrile, vinyl pyrrolidone, vinyl pyridine and dimethyl aminomethyl methacrylate.

12. The toner as claimed in claim 5, wherein said olefin polymer or copolymer is selected from the group consisting of polyethylene, polypropylene, a copolymer of ethylene and propylene, a copolymer of ethylene and vinyl acetate, a copolymer of ethylene, vinyl acetate and acrylic acid, a copolymer of ethylene and acrylic acid, a copolymer of ethylene, propylene and maleic acid, a copolymer of propylene and ethyl acrylate, a copolymer of ethylene, ethyl acrylate and glycidyl methacrylate, a copolymer of propylene and maleic anhydride, and a copolymer of ethylene, ethylacrylate and maleic anhydride.

13. The toner as claimed in claim 1, wherein said fluorine-contained monomer is a fluoroalkyl acrylate.

14. The toner as claimed in claim 1, wherein said fluorine-contained monomer is a fluoroalkyl methacrylate.

15. The toner as claimed in claim 1, wherein the ratio by weight of the amount of said fluorine-contained monomer to the amount of said main polymer for preparation of said fluorine-contained graft copolymer is in a range of (50 to 99) to (1 to 50).

16. Toner particles having a particle size of 5–30 μm for developing latent electrostatic images comprising a coloring agent and a fluorine-contained graft copolymer which is prepared by grafting a fluorine-contained monomer to a main polymer comprising a repeating unit represented by formula (I):

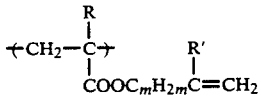

(I)

wherein R and R' each independently represent H or $CH_3$, and m represents an integer of 1 to 20.

17. The toner particles as claimed in claim 16, wherein said main polymer further comprises a repeating unit represented by formula (II):

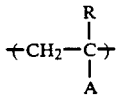

(II)

wherein R represents H or $CH_3$, and A represents $-COOC_nH_{2n+1}$ or $-OCOC_nH_{2n+1}$ in which n is an integer of 6 to 20.

18. The toner particles as claimed in claim 16, wherein said main polymer further comprises a monomer unit having a polar group.

19. The toner particles as claimed in claim 16, wherein said main polymer further comprises a lower vinyl-type monomer unit.

20. The toner particles as claimed in claim 16, wherein said main polymer further comprises an olefin polymer or copolymer.

21. The toner particles as claimed in claim 17, wherein said repeating unit of formula (II) is selected from the group consisting of the monomer units of lauryl acrylate, lauryl methacrylate, stearyl methacrylate, 2-ethylhexyl methacrylate, 2-ethylhexyl acrylate, dodecyl methacrylate, dodecyl acrylate, hexyl methacrylate, hexyl acrylate, octyl acrylate, octyl methacrylate, cetyl methacrylate, cetyl acrylate, vinyl laurate, vinyl stearate, nonyl methacrylate, nonyl acrylate, decyl methacrylate, decyl acrylate, cyclohexyl methacrylate and cyclohexyl acrylate.

22. The toner particles as claimed in claim 18, wherein said polar group of said monomer unit is selected from the group consisting of a carboxyl group, a glycidyl group and a hydroxyl group.

23. The toner particles as claimed in claim 18, wherein said monomer unit is selected from the group consisting of the monomer units of acrylic acid, methacrylic acid, itaconic acid, maleic acid, and fumalic acid.

24. The toner particles as claimed in claim 18, wherein said monomer unit is selected from the group consisting of the monomer units of glycidyl acrylate, glycidyl methacrylate, glycidylpropyl methacrylate, glycidylpropyl acrylate, glycidylbutyl acrylate, and glycidylbutyl methacrylate.

25. The toner particles as claimed in claim 18, wherein said monomer unit is selected from the group consisting of the monomer units of hydroxyethyl methacrylate, and hydroxyethyl acrylate.

26. The toner particles as claimed in claim 19, wherein said lower vinyl-type monomer unit is selected from the group consisting of the monomer units of methyl methacrylate, methyl acrylate, ethyl acrylate, ethyl methacrylate, propyl methacrylate, propyl acrylate, n-butyl methacrylate, iso-butyl methacrylate, vinyl acetate, vinyl toluene, styrene, p-chlorostyrene, divinyl benzene, diethylene glycol dimethacrylate, trimethyrol propane trimethacrylate, dimethyl aminoethyl methacrylate, acrylonitrile, vinyl pyrrolidone, vinyl pyridine and dimethyl aminomethyl methacrylate.

27. The toner particles as claimed in claim 20, wherein said olefin polymer or copolymer is selected from the group consisting of polyethylene, polypropylene, a copolymer of ethylene and propylene, a copolymer of ethylene and vinyl acetate, a copolymer of ethylene, vinyl acetate and acrylic acid, a copolymer of ethylene and acrylic acid, a copolymer of ethylene, propylene and maleic acid, a copolymer of propylene and ethyl acrylate, a copolymer of ethylene, ethyl acrylate and glycidyl methacrylate, a copolymer of propylene and maleic anhydride, and a copolymer of ethylene, ethylacrylate and maleic anhydride.

28. The toner particles as claimed in claim 16, wherein said fluorine-contained monomer is a fluoroalkyl acrylate.

29. The toner particles as claimed in claim 16, wherein said fluorine-contained monomer is a fluoroalkyl methacrylate.

30. The toner particles as claimed in claim 16, wherein the ratio by weight of the amount of said fluorine-contained monomer to the amount of said main polymer for preparation of said fluorine-contained graft copolymer is in a range of (50 to 99) to (1 to 50).

31. Toner particles utilizable with a nonpolar solvent for developing latent electrostatic images comprising a coloring agent and a fluorine-contained graft copolymer which is prepared by grafting a fluorine-contained monomer to a main polymer comprising a repeating unit represented by formula (I):

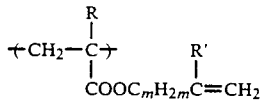

(I)

wherein R and R' each independently represent H or $CH_3$, and m represents an integer of 1 to 20.

32. The toner particles as claimed in claim 31, wherein said main polymer further comprises a repeating unit represented by formula (II):

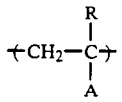

(II)

wherein R represents H or $CH_3$, and A represents $-COOC_nH_{2n+1}$ or $-OCOC_nH_{2n+1}$ in which n is an integer of 6 to 20.

33. The toner particles as claimed in claim 31, wherein said main polymer further comprises a monomer unit having a polar group.

34. The toner particles as claimed in claim 31, wherein said main polymer further comprises a lower vinyl-type monomer unit.

35. The toner particles as claimed in claim 31, wherein said main polymer further comprises an olefin polymer or copolymer.

36. The toner particles as claimed in claim 32, wherein said repeating unit of formula (II) is selected from the group consisting of the monomer units of lauryl acrylate, lauryl methacrylate, stearyl methacrylate, 2-ethylhexyl methacrylate, 2-ethylhexyl acrylate, dodecyl methacrylate, dodecyl acrylate, hexyl methacrylate, hexyl acrylate, octyl acrylate, octyl methacrylate, cetyl methacrylate, cetyl acrylate, vinyl laurate, vinyl stearate, nonyl methacrylate, nonyl acrylate, decyl methacrylate, decyl acrylate, cyclohexyl methacrylate and cyclohexyl acrylate.

37. The toner particles as claimed in claim 33, wherein said polar group of said monomer unit is selected from the group consisting of a carboxyl group, a glycidyl group and a hydroxyl group.

38. The toner particles as claimed in claim 33, wherein said monomer unit is selected from the group consisting of the monomer units of acrylic acid, methacrylic acid, itaconic acid, maleic acid, and fumalic acid.

39. The toner particles as claimed in claim 33, wherein said monomer unit is selected from the group consisting of the monomer units of glycidyl acrylate, glycidyl methacrylate, glycidylpropyl methacrylate, glycidylpropyl acrylate, glycidylbutyl acrylate, and glycidylbutyl methacrylate.

40. The toner particles as claimed in claim 33, wherein said monomer unit is selected from the group consisting of the monomer units of hydroxyethyl methacrylate, and hydroxyethyl acrylate.

41. The toner particles as claimed in claim 34, wherein said lower vinyl-type monomer unit is selected from the group consisting of the monomer units of methyl methacrylate, methyl acrylate, ethyl acrylate, ethyl methacrylate, propyl methacrylate, propyl acrylate, n-butyl methacrylate, iso-butyl methacrylate, vinyl acetate, vinyl toluene, styrene, p-chlorostyrene, divinyl benzene, diethylene glycol dimethacrylate, trimethyrol propane trimethacrylate, dimethyl aminoethyl methacrylate, acrylonitrile, vinyl pyrrolidone, vinyl pyridine and dimethyl aminomethyl methacrylate.

42. The toner particles as claimed in claim 35, wherein said olefin polymer or copolymer is selected from the group consisting of polyethylene, polypropylene, a copolymer of ethylene and propylene, a copolymer of ethylene and vinyl acetate, a copolymer of ethylene, vinyl acetate and acrylic acid, a copolymer of ethylene and acrylic acid, a copolymer of ethylene, propylene and maleic acid, a copolymer of propylene and ethyl acrylate, a copolymer of ethylene, ethyl acrylate and glycidyl methacrylate, a copolymer of propylene and maleic anhydride, and a copolymer of ethylene, ethylacrylate and maleic anhydride.

43. The toner particles as claimed in claim 31, wherein said fluorine-contained monomer is a fluoroalkyl acrylate.

44. The toner particles as claimed in claim 31, wherein said fluorine-contained monomer is a fluoroalkyl methacrylate.

45. The toner particles as claimed in claim 31, wherein the ratio by weight of the amount of said fluorine-contained monomer to the amount of said main polymer for preparation of said fluorine-contained graft copolymer is in a range of (50 to 99) to (1 to 50).

* * * * *